United States Patent [19]

Everett

[11] Patent Number: 4,606,467

[45] Date of Patent: Aug. 19, 1986

[54] DISPLAY STAND STRUCTURE

[75] Inventor: Lynn E. Everett, New Philadelphia, Ohio

[73] Assignee: Tusco Manufacturing Co., Gnadenhutten, Ohio

[21] Appl. No.: 747,577

[22] Filed: Jun. 24, 1985

[51] Int. Cl.[4] ..... A47F 7/00

[52] U.S. Cl. ..... 211/60.1; 211/208; 248/220.3

[58] Field of Search ..... 211/60.1, 70.6, 208, 211/133, 205, 189, 190, 24, 13, 49.1, 59.2, 26; 248/220.3, 222.4, 221.1, 221.2

[56] References Cited

U.S. PATENT DOCUMENTS

| | | | |
|---|---|---|---|
| 749,494 | 1/1904 | Mason | 211/205 X |
| 1,810,826 | 6/1931 | Gray | 211/70.6 X |
| 2,059,445 | 11/1936 | Eastman | 211/70.6 |
| 3,014,597 | 12/1961 | McWherter | 248/220.4 X |
| 3,392,847 | 7/1968 | Holland et al. | 211/13 |
| 3,524,616 | 8/1970 | Marschak | 211/205 X |
| 3,528,558 | 9/1970 | Williams | 211/59.2 |
| 3,908,832 | 9/1975 | Marshall | 211/133 |

*Primary Examiner*—Robert W. Gibson, Jr.
*Attorney, Agent, or Firm*—Marshall & Melhorn

[57] ABSTRACT

A display stand having a column extending upwardly from a base wherein vertically spaced holders horizontally support elongate products on the column. Wing panels mounted in spaced relation to opposed sides of the column enhance the appearance of the display stand. A header extends between upper portions of the wing panels and carries advertising for the displayed products.

6 Claims, 4 Drawing Figures

As illustrated in FIG. 1, a pair of substantially L-shaped support wires 34*a* and 34*b* extend between the angle support members 16 affixed to the base 12 and the tie bar 26. The ends of the L-shaped support wires 34*a* and 34*b* are adapted to be snapped into apertures 16*a* (see FIG. 2) provided in the angle support member 16 and apertures 14*j* provided in the face 14*a* of the column 14 adjacent the top of the tie bar 26. The spaced apart, generally vertically extending support wires 34*a* and 34*b* cooperate to vertically support products such as automotive coil springs.

If desired, appropriate lighting fixtures (not shown) may be mounted between the side wings of the panels 18 and 20 and the sides 14*b* of the column 14 for illuminating and causing attention to be focused on the display products and providing a "shadow box" effect. Lighting fixtures may also be mounted within the header panel 24 for the same purposes.

It will be appreciated from the foregoing description that the invention has resulted in a display stand structure for enhancing a product display which is stable and rugged in use and comprised of a minimum number of components. Furthermore, the components can be quickly and economically assembled without the requirement of any particular expertise.

In accordance with the provisions of the Patent Statutes, the principle and mode of operation of the invention has been explained and what is considered to represent its preferred embodiment is illustrated and described. It should, however, be understood that the invention may be practiced otherwise than as specifically illustrated and described without departing from its spirit and scope.

What I claim is:

1. A display stand for displaying elongate products, said stand comprising;

(a) a base;

(b) a column having at least a front panel and two opposed side panels mounted on said base;

(c) a pair of elongate angle-shaped wing panels each having a side wing, one mounted on each opposed side of said column with said side wing of said angle-shaped wing in spaced relation to the adjacent opposed side panel of said column;

(d) means extending between and secured to the side wings of said pair of wing panels and to the front panel of said column; and (e) means for horizontally supporting the elongate products on the front panel of said column between the side wings of said pair of elongate angle-shaped wing panels.

2. The invention defined in claim 1 including a header panel extending between and secured to the upper ends of the side wings of said pair of elongate angle-shaped wing panels.

3. The invention defined in claim 1 wherein said column comprises an elongate substantially U-shaped member and the front panel includes a number of pair of vertically spaced apertures and said means for supporting an elongated product comprises wire holders having end portions for cooperating with the apertures for supporting the wire holder in vertically spaced relation.

4. The invention defined in claim 1 including L-shaped wire means extending vertically between said base and the front panel of said column in close relation to said means extending between said wing panels.

5. An upstanding and fabricated of sheet metal stand, said stand comprising:

(a) a base;

(b) an elongate substantially U-shaped column having a front panel and two opposed side panels affixed to said base in an upright position;

(c) a pair of elongate angle-shaped wing panels mounted in upright spaced relation to each opposed side panel of said column, said wing panels having side wings spaced above said base and extending above the top of said column;

(d) header means connected to and extending between the upper portion of the side wings of said wing panels and extending above the top of said column;

(e) tie means connected to and extending between a lower portion of the side wings of said wing panels, said tie means being connected to the front panel of said column; and (f) support means detachably secured to the front face of said column for holding elongate products in horizontal positions.

6. The invention defined in claim 5 including means detachably secured to said base and the front panel of said column for supporting elongate products in the substantially vertical position.

* * * * *

DISPLAY STAND STRUCTURE

BACKGROUND OF THE INVENTION

This invention generally relates to display stands and, more particularly, to display stands for displaying relatively large, elongate products such as automotive shock absorbers, MacPherson strut assemblies, and the like.

The display of the elongate specialized products is a paramount problem for retailers and commercial establishments. Such products are sold in mass merchandising outlets, chain store outlets, specialty shops and the like. The products are displayed in specially designed display racks and stands to attract and entice consumers. Accordingly, it is desirable to produce a unique display structure for elongated products such as automotive shock absorbers, struts and related springs for producing an enticing display.

SUMMARY OF THE INVENTION

The invention is directed to an upstanding stand structure for displaying specialized elongate products. Briefly, the display stand structure comprises an upright product supporting column mounted on a base and adapted to hold a number of elongate products in vertically spaced relation. A pair of wing panels and a header panel are attached to the product supporting column for enhancing and advertising the display products.

An object of the invention is to produce a unique display structure which attracts and entices consumers and yet is a rigid, inherently stable structure which is easy and economic to install as well as rugged in use.

Still a further object of the invention is to produce a display stand capable of displaying products which can be touched and handled by prospective purchasers to thereby assist in the merchandising of the products.

Another object of the invention is to produce a stand for displaying products in a unique and fanciful manner and permitting the selective display of a variety of products.

BRIEF DESCRIPTION OF THE DRAWINGS

The above as well as other objects of the invention will become readily apparent to one skilled in the art from reading the following detailed description of the preferred embodiment of the invention when considered in light of the accompanying drawings, in which.

DETAILED DESCRIPTION OF THE PREFERRED EMBODIMENT

Figure 1:
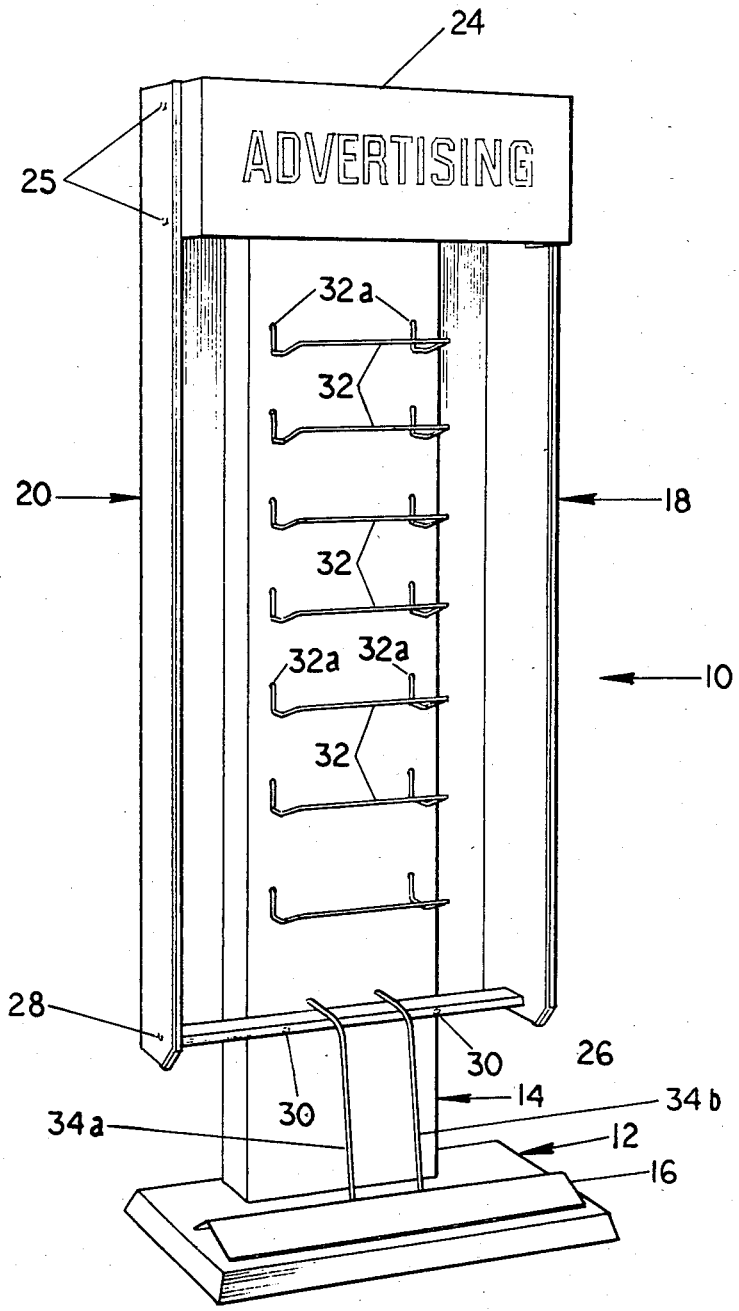
FIG. 1 is a perspective view of an upstanding display stand constructed in accordance with the invention.

Referring to the drawings wherein like reference numerals designate similar parts throughout, there is illustrated an upright display stand structure 10 including a base 12 and a product support column 14.

Figure 2:
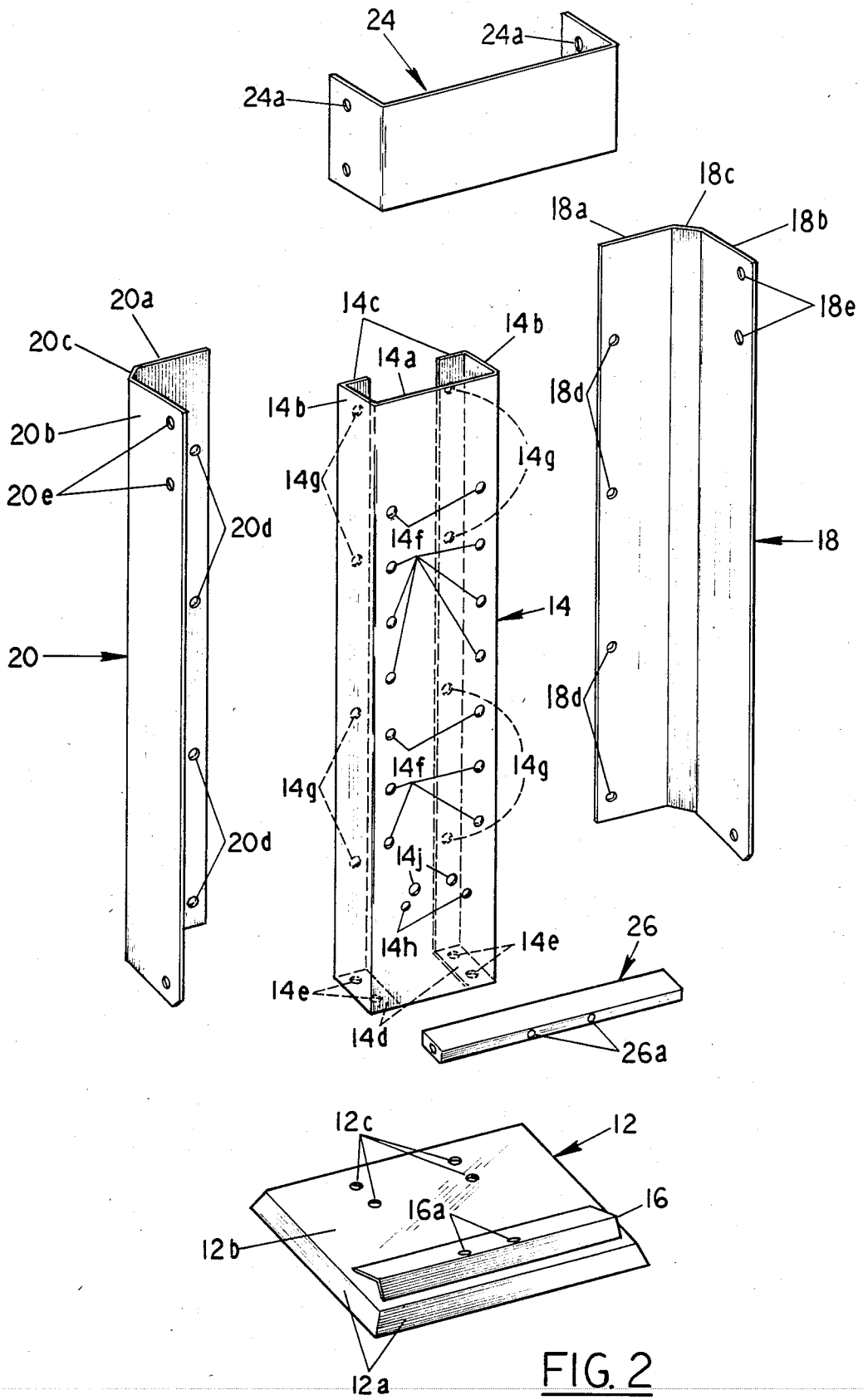
FIG. 2 is an exploded perspective view illustrating the component parts employed in the construction of the display stand illustrated in FIG. 1.

As best illustrated in FIGS. 1 and 2, the base 12 may be a sheet metal stamping of rectangular shape and includes sides 12*a* supporting an upper horizontal planar surface 12*b*. The horizontal planar surface 12*b* includes a number of apertures 12*c* disposed in spaced relation to one of the sides, the purpose of which will be described hereinafter. An elongate angle support member 16 is fixedly mounted on the planar surface 12*b* of the base 12 in opposed transverse relation to the apertures 12*c*.

Figure 3:
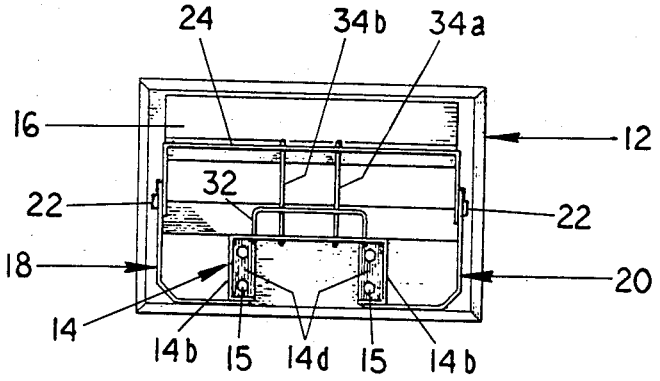
FIG. 3 is a top plan view of the display stand illustrated in FIG. 1.

Referring specifically to FIG. 2, the product support column 14 generally comprises an elongate U-shaped channel member comprising a front panel 14*a*, opposed side panels 14*b*, each having an inwardly extending flange 14*c*. A flange 14*d* (see also FIG. 3) having a number of apertures 14*e* may be affixed to the bottom end of each side panel 14*b*, as illustrated in FIG. 2. It will be noted that an aperture 14*e* aligns with an aperture 12*c* for receiving threaded fasteners 15, for example (see FIG. 3) for securing the support column 14 to the base 12. The front panel 14*a* is provided with a number of pairs of vertically spaced apertures 14*f*, the purpose of which will be described hereinafter.

A righthand (as viewed in FIGS. 1, 2 and 3), elongate angle shaped wing panel 18, having a back flange 18*a* and a side wing 18*b* interconnected by an angular portion 18*c*, is mounted on the inwardly extending flange 14*c* on the righthand side of the column 14 with the side wing 18*b* in spaced relation to the side 14*b* of the column 14. Similarly, a lefthand (as viewed in FIGS. 1, 2, and 3), elongate angle shaped wing panel 20, having a back flange 20*a* and a side wing 20*b* interconnected by an angular portion 20*c*, is mounted on the inwardly extending flange 14*c* on the left-hand side of the column 14 with the wing 20*b* in spaced relation to the side 14*b* of the column 14.

Figure 4:
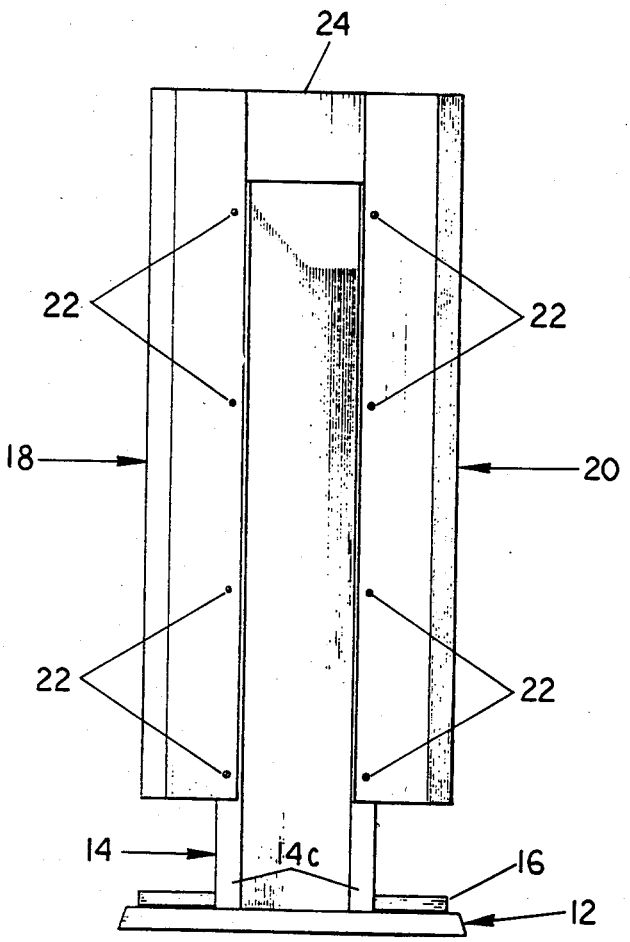
FIG. 4 is a rear elevational view of the display stand illustrated in FIG. 1.

As best illustrated in FIG. 4, the back flanges 18*a* and 20*a* of the wing panels 18 and 20, respectively, are positioned on the flanges 14*c* of the column 14 so that the upper ends thereof extend above the top of the column 14. Each wing panel 18 and 20 is attached to the flange 14*c* by threaded fasteners 22, for example, adapted to pass through aligned apertures 18*d*, 14*g*, and 20*d*, 14*g* and the members 18 and 20 and the flanges 14*c*, respectively (see FIGS. 2 and 4). The bottom ends of the wing panels 18 and 20 are positioned above the top surface 12*b* of the base 12 for aesthetic purposes.

Referring specifically to FIGS. 1 and 2, a U-shaped header panel 24 is attached to the upper end of the wing panels 18 and 20 by threaded fasteners 25, for example, adapted to pass through aligned apertures 24*a*, 20*e* and 24*a*, 18*e* respectively. The header 24 strengthens and supports the upper ends of the side flanges 18*b* and 20*b*. Also, the header 24 is adapted to carry appropriate advertising messages.

Similarly, a tie bar 26, extending between the lower ends of the side flanges 18*b* and 20*b* is attached thereto by threaded fastener 28, for example (see FIG. 1). Also, the tie bar 26 is attached to the front panel 14*a* of the column 14 by suitable threaded fasteners 30, for example, (see FIG. 1) passing through aligned apertures 14*h* and 26*a* in each member for producing a stable, rugged structure.

Referring now to FIG. 1, there is illustrated a number of wire holders 32. Each wire holder 32 is provided with spaced end portions 32*a* adapted to be snapped into a selected pair of apertures 14*f*. Also, each wire holder 32 is shaped to receive and support an elongate product such as an automotive shock absorber (not shown).